US011498648B1

(12) United States Patent
Grogan

(10) Patent No.: US 11,498,648 B1
(45) Date of Patent: Nov. 15, 2022

(54) WATERCRAFT STORAGE STRUCTURE

(71) Applicant: Richard Grogan, New Richmond, OH (US)

(72) Inventor: Richard Grogan, New Richmond, OH (US)

( * ) Notice: Subject to any disclaimer, the term of this patent is extended or adjusted under 35 U.S.C. 154(b) by 0 days.

(21) Appl. No.: 17/320,466

(22) Filed: May 14, 2021

Related U.S. Application Data

(60) Provisional application No. 63/027,948, filed on May 20, 2020.

(51) Int. Cl.
*B63C 5/02* (2006.01)
*B63C 1/00* (2006.01)
*B63C 15/00* (2006.01)

(52) U.S. Cl.
CPC ..... *B63C 5/02* (2013.01); *B63C 1/00* (2013.01); *B63C 15/00* (2013.01)

(58) Field of Classification Search
CPC .. B63C 15/00; B63C 1/00; B63C 3/00; B63C 3/12; B63C 5/02
See application file for complete search history.

(56) References Cited

U.S. PATENT DOCUMENTS

| | | | | |
|---|---|---|---|---|
| 2,101,317 | A * | 12/1937 | Felix | E04G 7/16 403/53 |
| 3,567,035 | A * | 3/1971 | Dudzik | F16B 7/0493 211/175 |
| 4,074,811 | A * | 2/1978 | Filak | E04B 1/24 248/245 |
| 4,237,798 | A | 12/1980 | Welsch et al. | |
| 4,811,670 | A | 3/1989 | Kolvites et al. | |
| 7,618,223 | B1 * | 11/2009 | Begley | A61G 7/1059 414/921 |
| 9,084,482 | B2 | 7/2015 | Botkin | |
| 9,695,976 | B2 | 7/2017 | Hill et al. | |
| 2005/0016438 | A1 * | 1/2005 | Hey | B63B 17/02 114/361 |
| 2014/0328627 | A1 * | 11/2014 | King | B63C 3/12 114/263 |
| 2017/0043849 | A1 * | 2/2017 | Brown | B63C 3/06 |

* cited by examiner

*Primary Examiner* — Andrew Polay
(74) *Attorney, Agent, or Firm* — Mark F. Smith; Smith Brandenburg Ltd

(57) ABSTRACT

A watercraft storage structure for storing a watercraft comprises a plurality of supports, wherein each support includes a clamping bracket; a shelf slidably attached to the plurality of supports by the clamping bracket attached to each plurality of supports forming a watercraft storage area; and a support platform positioned within the watercraft storage area, wherein the support platform is adapted for supporting a watercraft; wherein the each clamping bracket includes a first plate and a second plate that operate to press against the support forming a frictional fit with the support.

10 Claims, 8 Drawing Sheets

WATERCRAFT STORAGE STRUCTURE

The Present application hereby claims benefit to and incorporates in its entirety by reference the subject matter contained in U.S. Provisional Patent Application No. 63/027,948, filed May 20, 2020, titled: Storage Assembly.

The present invention is a watercraft storage structure, which utilizes previously unused space above a watercraft storage location without damaging the watercraft storage structure. The core components of the invention are a shelf and clamping brackets, which, generally speaking, are configured as follows: clamping brackets are affixed to the shelf and are configured to connect the shelf to supports of a watercraft storage location in order to suspend the shelf above a watercraft storage area. The invention can be used for suspending a storage assembly, such as a shelf, above a watercraft storage area of a watercraft storage structure without damaging the watercraft storage structure. This is accomplished by using clamping brackets to secure the shelf to the supports of the watercraft storage structure.

BACKGROUND OF THE INVENTION

Watercraft storage structures such as docks and moorages often do not include any storage area for equipment for the boat. This requires boat owners to either store equipment for the boat in the boat or on shore. Many personal watercraft do not have significant storage capabilities and storing equipment on shore can be a significant inconvenience.

Some docks include storage on the area that otherwise would be used for foot traffic. This can increase costs of the dock significantly by increasing the area that must be suspended above the water. These storage solutions also are generally inadequate for storing all of the equipment needed for the boat let alone voluminous accessories such as intertubes, kayaks, waterskis, etc.

SUMMARY OF THE INVENTION

The disclosed device is unique when compared with other known devices and solutions at least because it provides: (1) significant storage in an area previously unused; (2) mounting and dismounting with no damage to the watercraft storage structure; and (3) the storage structure is moderately adjustable in length and width.

The disclosed device is unique in that it is structurally different from other known devices or solutions. More specifically, the device is unique at least due to the presence of: (1) storage assembly with moderately adjustable length and width; (2) clamping brackets which secure a shelf without damaging the watercraft storage structure; and (3) clamping brackets configured to be removable and easily adjust the height of the shelf.

A preferred embodiment of the invention is a watercraft storage structure for storing a watercraft partially or totally out of the water, the watercraft storage structure comprises a plurality of supports, wherein each support includes a clamping bracket; a shelf slidably attached to the plurality of supports by the clamping bracket attached to each plurality of supports forming a watercraft storage area; and a support platform positioned within the watercraft storage area, wherein the support platform is adapted for lifting and supporting a watercraft partially or totally out of the water; wherein the each clamping bracket includes a first plate and a second plate that operate to press against the support forming a frictional fit with the support.

In a preferred embodiment of the invention wherein each clamping bracket includes a u-shaped bracket and shelf includes a plurality of support members. and wherein each support member is supported within one u-shaped bracket.

In a preferred embodiment of the invention each of the clamping bracket includes one or more clamping bolts which operate to in increase the frictional fit of the first plate and the second plate against the support when the one or more clamping bolts are tightened.

In a preferred embodiment of the invention the watercraft storage structure further comprises a roof positioned over the shelf.

In a preferred embodiment of the invention the plurality of supports are connected to a dock.

Another preferred embodiment of the invention is a watercraft storage structure for storing a watercraft partially or totally out of the water, the watercraft storage structure comprises a plurality of supports, wherein one or more of the plurality of supports is connected to a dock and wherein each support includes a clamping bracket; a shelf having a plurality of support members wherein the shelf is slidably attached to the plurality of supports by the clamping bracket attached to each plurality of supports forming a watercraft storage area; a roof positioned over the shelf and attached to the plurality of supports; a support platform positioned within the watercraft storage area, wherein the support platform is adapted for supporting a watercraft partially or totally out of the water; wherein each clamping bracket includes a u-shaped bracket for receive a portion of a support member a first plate and a second plate that operate to press against the support forming a frictional fit with the support; and wherein each clamping bracket includes one or more clamping bolts which operate to in increase the frictional fit of the first plate and the second plate against the support when the one or more clamping bolts are tightened.

DETAILED DESCRIPTION OF THE INVENTION

In the Summary above and in this Detailed Description, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used-to the extent possible-in combination with and/or in the context of other particular aspects and embodiments of the invention, and in the invention generally.

The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range including that number (which may be a range having an upper limit or no upper limit, depending on the variable being defined). For example, "at least 1" means 1 or more than 1. The term "at most" followed by a number is used herein to denote the end of a range, including that number (which may be a range having 1 or as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose limits include both numbers. For example, "25 to 100" means a range whose lower limit is 25 and upper limit is 100, and includes both 25 and 100.

Figure 1:
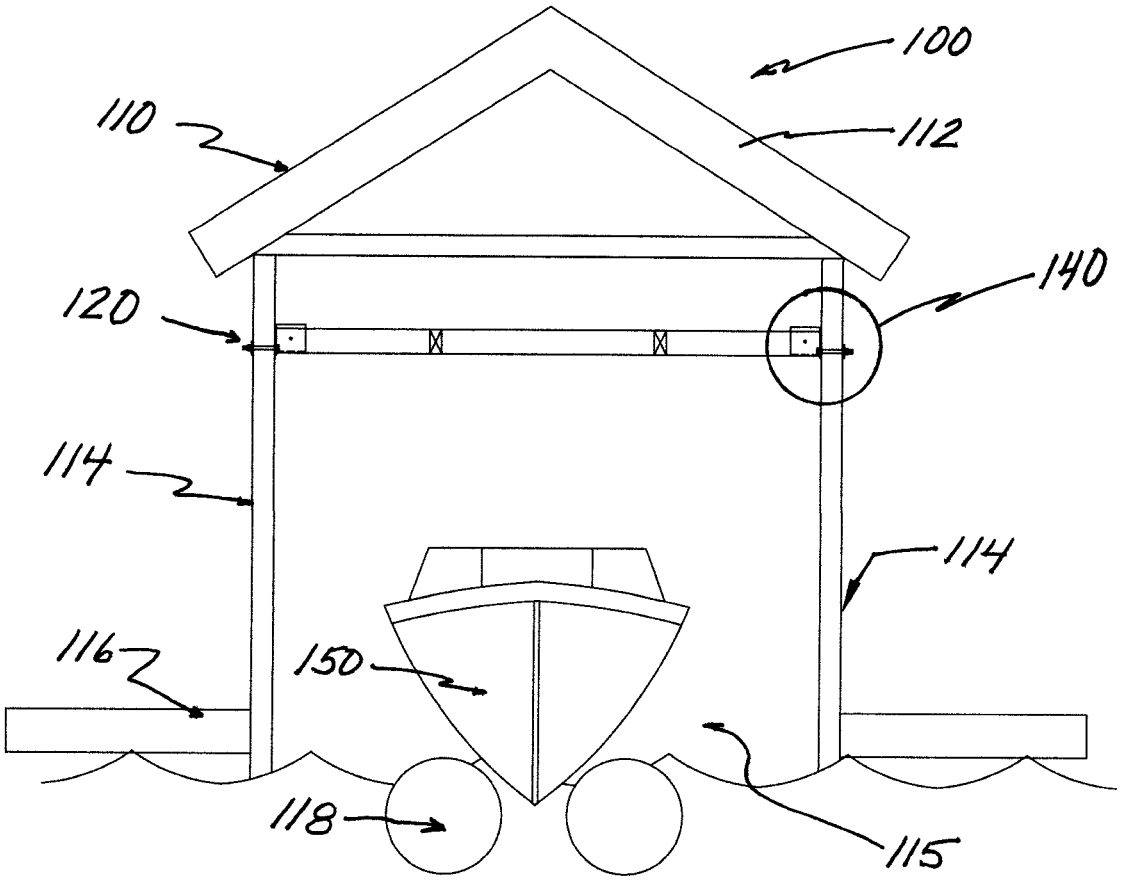
FIG. 1 shows a front view of an example watercraft storage structure.

FIG. 1 shows a front view of an example watercraft storage structure 100. The watercraft storage structure 100 may include a watercraft storage structure assembly 110, clamping brackets 120, a shelf 130, and watercraft 150. The watercraft storage structure assembly 110 may include a roof 112, supports 114, watercraft storage area 115, a dock 116, and a support platform 118. The supports 114 may hold up the roof 112 at four or more points. The support platform 118 may partially or completely lift the watercraft 150 out of the water and may secure the watercraft 150 in place in the watercraft storage area 115.

The clamping brackets 120 may be affixed to the supports 114 at connection points 140. The clamping brackets 120 may also be secured to and support the shelf 130. The clamping brackets 120 and shelf 130 may be together considered a shelving assembly. The connection points 140 may be adjusted based on the preferences of a user. For example, if a user desires to use the shelf to store very voluminous items like inner tubes, the connection point 140 may be lower to give more room above the shelf 130 for storage. As another example, if the user desires for more head room above the watercraft 150, then the connection point 140 may be higher. As will be described in greater detail below, the clamping brackets 120 do not require holes or detents in the supports 114 to support the shelf 130. Accordingly, the connection point 140 may be changed quickly and easily depending on the current needs of the user. The shelf 130, when connected to the supports 114 by the clamping brackets 120, are arranged above and aligned with the watercraft storage area 115 and below and aligned with the roof 112.

The dock 116 may be connected to at least some of the supports 114. The dock 116 may be configured for boaters to go from shore to the watercraft 150 on foot.

Figure 2:
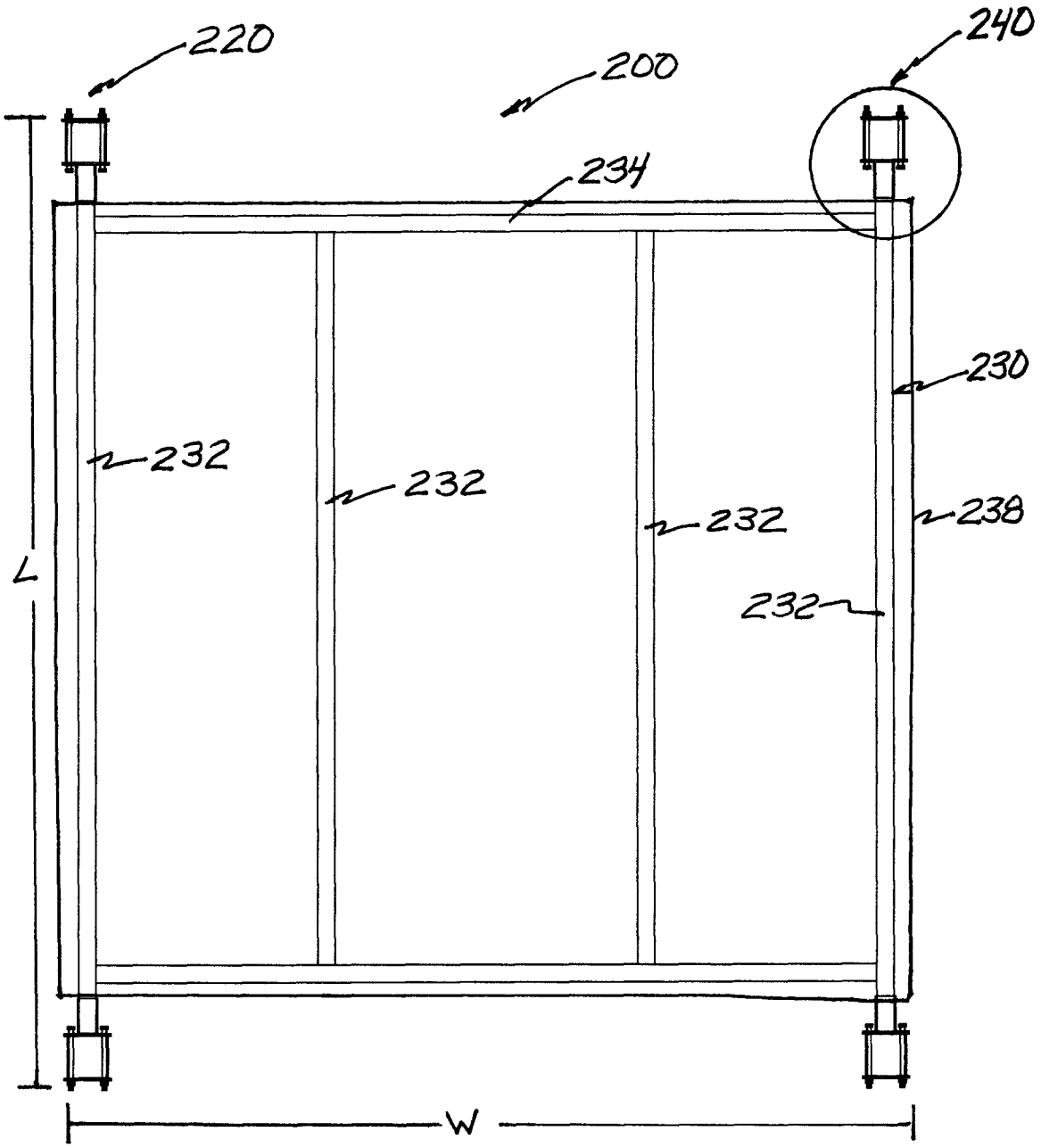
FIG. 2 shows an example storage structure.

FIG. 2 shows an example storage assembly 200. The storage structure 200 includes clamping brackets 220 and shelf 230. As will be described in greater detail below, the clamping brackets 220 and the shelf 230 may be connected such that moderate adjustments to the length L of the storage structure 200 may be made. The storage structure 200 is arranged to have a width W and length L which substantially are the same as the spaces between the supports 114, such that each clamping bracket 220 may connect with one of the supports 114 at connection points 240.

The shelf 230 may comprise several connected support members 232, 234, 236. The support members 232, 234, 236 may be boards, PVC pipes, plastic, carbon fiber rods, aluminum rods, steel beams or any other similar materials suitable for creating a stable platform or shelf. For example, as shown in FIG. 2, the shelf 230 may comprise connection support members 232 connected to the clamping brackets 220, cross support members 234 connected between the connection support members 232, and auxiliary support members 236 connected between the cross support members 234. Optionally the shelf 230 may include a cover 238 over the connected support members 232, 234, 236. The cover 238 may be plywood, a wire mesh, netting, plastic or metal sheet or any other suitable material for providing a platform for holding articles. In some embodiments, when large items, such as kayaks or inner tubes are being stored above the watercraft 150, no cover 238 may be included. The arrangement of connected support members depicted in FIG. 2 is merely an example, any configuration of connected support members 232, 234, 236 may be used in the shelf 230. The connected support members 232, 234, 236 may be connected to each other by nails, brackets, welds, 't' connectors, or any other suitable means for connecting the connected support members 232, 234, 236 to form the shelf 230.

Figure 3A:
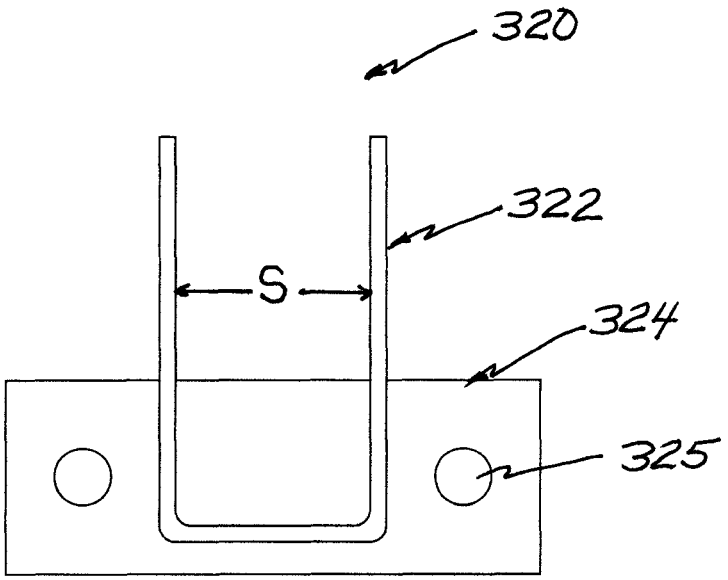
FIG. 3A shows a front view of a first example clamping bracket.

FIG. 3A shows a front view of an example first clamping bracket 320. The first clamping brackets 320 may be made of steel or other suitable materials. All four of the clamping brackets 220 shown in FIG. 2 may be first clamping brackets 320. The first clamping bracket 320 may include a 'u' shaped bracket 322 welded to or otherwise connected to a first plate 324 with holes 325. The 'u' shaped bracket 322 may have an interior span S complementary to the width of the connection support member 232. For example, if the connection support member 232 is a 2"×4" board, the span S of 'u' shaped bracket 322 may be about 2.25 inches. In some example embodiments, the connection support member 232 may narrow at the point where it enters the 'u' shaped bracket 322 such that the span S of the 'u' shaped bracket 322 is smaller than the thickness of the connection support member 232 at a thickest point in the connection support member 232.

Figure 3B:
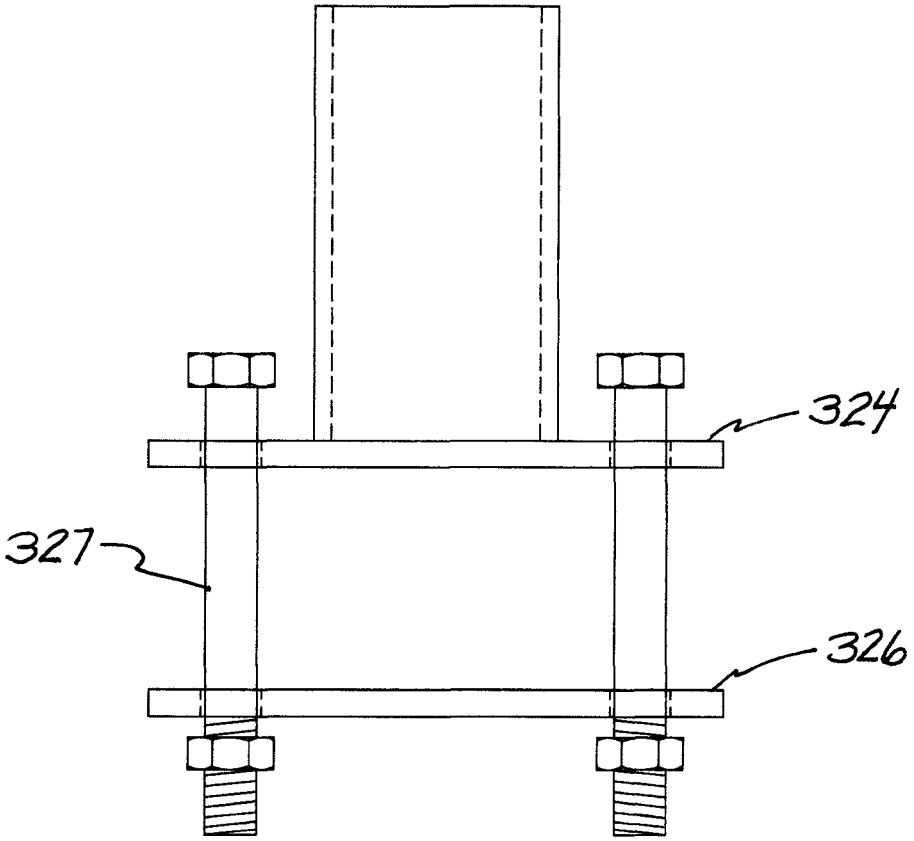
FIG. 3B shows a top view of the first example clamping bracket.

FIG. 3B shows a top view of the example first clamping bracket 320. The first clamping bracket 320 may also include a second plate 326 and clamping bolts 327. The clamping bolts 327 may pass through the holes 325 in the first plate 324 and similar holes in the second plate 326. The second plate 326 may be substantially the same as the first plate 324 except that it is not welded or otherwise connected to a 'u' shaped bracket. The holes 325 are placed at a sufficient distance from one another that the support 114 may fit in between the clamping bolts 327 with some additional space to allow for adjustments. In some example embodiments, the additional space may be about one inch.

When the first clamping bracket 320 is attached to the supports 114, the clamping bolts 327 may be twisted to tighten the first and second plates 324, 326 on either side of the support 114 until the first clamping bracket 320 is securely held in place by friction force. Accordingly, no screws or detents are needed to secure the first clamping brackets 320 in place. Also, the first clamping brackets 320 may be secured without causing any significant damage to the supports 114. The supports 114 are in water and may be treated so they will not corrode or deteriorate in the wet conditions. Many of these treatments would not be effective if holes were drilled through the supports 114. For example, if the support is a 4"×4" board which is treated with a sealant, drilling a hole through the board to secure a shelf 130 would allow moisture into the board, circumventing the sealant treatment, and may cause the supports 114 to rot.

Figure 3C:
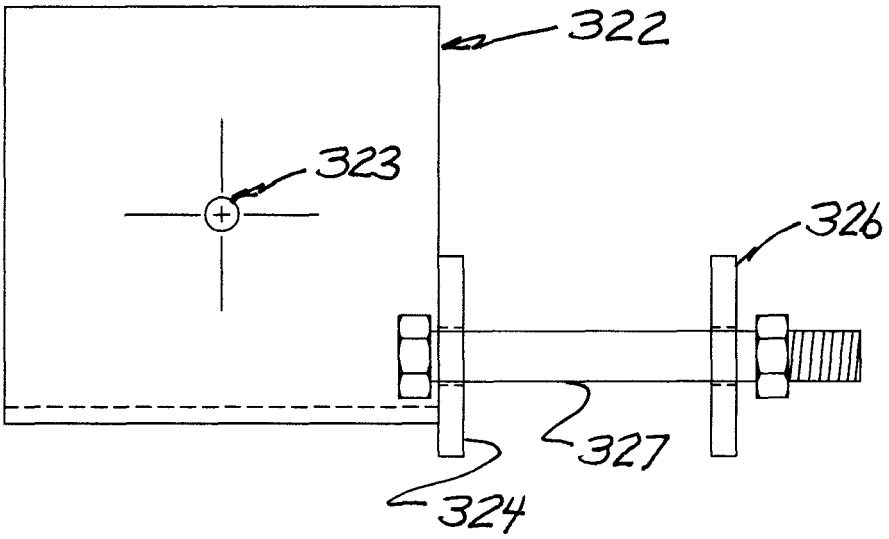
FIG. 3C shows a side view of the first example clamping bracket.

FIG. 3C shows a side view of the example first clamping bracket 320. The 'u' shaped bracket 322 may include at least one hole 323 for securing the connection support member 232 to the first clamping bracket 320. For example, if the connection support member 232 is a 2"×4" board, a wood screw or nail may be placed in the hole 323 to secure the connection support member 232 to the first clamping bracket 320. The hole 323 may be placed away from an edge of the 'u' shaped bracket 320 furthest from the shelf 230 when the clamping bracket is attached to the connection support member 232 in order to allow for moderate adjustments, about an inch, in the length L of storage assembly 200. For example, the hole 323 may be located in a center of the 'u' shaped bracket 232.

To assemble the storage structure 200, the first clamping brackets 320 may be connected to the supports 114 first. Then the shelf 230 may be placed into the first clamping brackets 320 and secured to the 'u' shaped brackets 322. In this manner even if the connection support members 232 are about an inch shorter than a distance between the first plates 324 of opposing first clamping brackets 320 on the supports 114, the connection support plates may be securely connected to the first clamping brackets 320.

The width of the first and second plates 324, 326 also provides for correction of moderate mismatches between the width W of the storage structure 200 and the distance between the supports 114. Accordingly, the flat shape of the first and second plates 324, 326 is advantageous for correcting moderate mismatches, about an inch depending on the length of the 'u' shaped bracket 322 and placement of the hole 323, between the width W of the storage structure 200 and the distance between the supports 114. Greater mismatches may be tolerated by making the holes 325 in the first and second plates 324, 326 further apart.

Figure 4A:
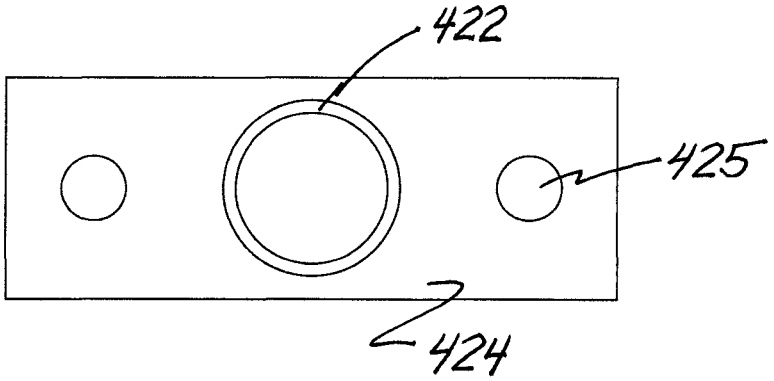
FIG. 4A shows a front view of a second example clamping bracket.

FIG. 4A shows a front view of an example second clamping bracket 420. The second clamping brackets 420 may be made of steel or other suitable materials. All four of the clamping brackets 220 shown in FIG. 2 may be second clamping brackets 420. The second clamping bracket 420 may include a circular connector 422 welded to or otherwise connected to a first plate 424 with holes 425. The circular connector 422 may have a diameter complementary to an internal diameter of the connection support member 232, if the connection support member is a pipe. For example, if the connection support member 232 is a PVC pipe or aluminum pipe with an internal diameter of 1.75 inches, the diameter of the circular connector 422 may be about 1.75 inches. In other example embodiments, the connection support member 232 may enter the circular connector 422 such that an interior diameter of the circular connector 422 is complementary to the exterior diameter of the connection support member 232.

Figure 4B:
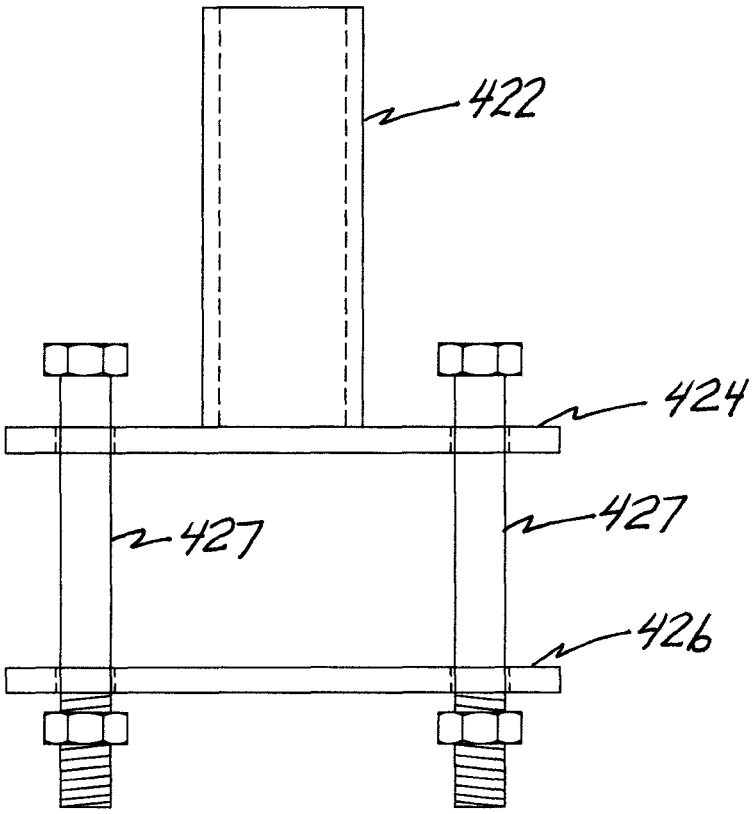
FIG. 4B shows a top view of the second example clamping bracket.

FIG. 4B shows a top view of the example second clamping bracket 420. The second clamping bracket 420 may also include a second plate 426 and clamping bolts 427. The clamping bolts 427 may pass through the holes 425 in the first plate 424 and similar holes in the second plate 426. The second plate 426 may be substantially the same as the first plate 424 except that it is not welded or otherwise connected to a circular connector. The holes 425 are placed at a sufficient distance from one another that the support 114 may fit in between the clamping bolts 427 with some additional space to allow for adjustments. Accordingly, the first and second plates 424, 426 and clamping bolts 427 of the second clamping bracket 420 may be substantially the same as the first and second plates 324, 326 and clamping bolts 327 of the first clamping bracket 320.

Figure 4C:
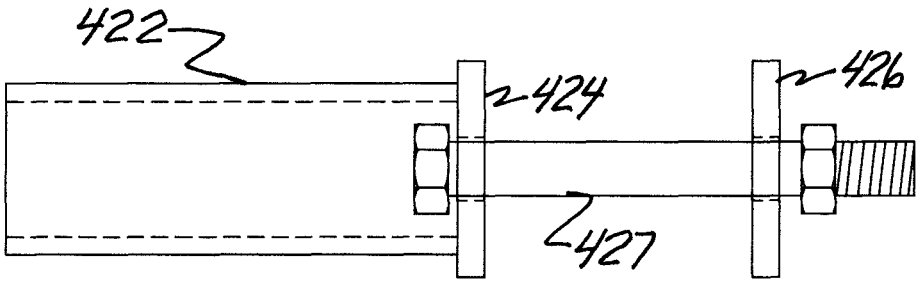
FIG. 4C shows a side view of the second example clamping bracket.

FIG. 4C shows a side view of another example second clamping bracket 420. The circular connectors 422 may be connected to the connection support members 232 by friction fit, glue, nails, or any other means of securing pipes to one another. The length of the circular connector 422 allows for moderate adjustments, about two or three inches depending on the length of the circular connector 422 and the materials used, in the length L of storage assembly 200. For example, the second clamping brackets 420 may be connected to the supports 114 first with the connection support members 232 connected to the circular connectors 422 but somewhat free to move. The second clamping brackets 420 may then be secured with the clamping process allowing for the length L of the storage structure 200 to adjust moderately to the distance between the supports 114. Then, if desired, the circular connectors 422 may be more securely affixed to the connection support members 232 by nails, glue or the like. The ability of the storage assembly to adjust in length L and width W has several advantages including: allowing the first or second clamping brackets 320, 420 to have as tight of a friction fit as possible, not damaging the supports 114 by not causing the supports to bow to adjust to the width W or length L of the storage structure 200, and the storage structure 200 has greater tolerance for measurement or manufacturing errors.

After securing the storage structure 200, the second clamping brackets 420 (or similarly the first clamping brackets 320) may be loosened or removed by loosening the clamping bolts 427. Accordingly, the connection point 140 of the second clamping brackets 420 (or similarly the first clamping brackets 320), and thus the height of the storage structure 200, may be easily changed by a user.

Accordingly, the present description provides for various embodiments for a storage structure for watercraft. Many uses and advantages are offered by the storage structure 200 as described above in one or more non-limiting embodiments in the present description. The use of u-shaped brackets allows support members to be easily nested in the u-shape bracket making it easier for an individual to place or remove the shelf in position, particularly when the storage structure is positioned over water. Further, the use of the u-shaped bracket allows more flexibility on the width of the support members thereby allowing larger or smaller diameter support members thereby increasing the strength and weight or decreasing the strength and weight depending on the user's needs.

The corresponding structures, materials, acts, and equivalents of any means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

The invention claimed is:

1. A watercraft storage structure for storing a watercraft partially or totally out of the water, the watercraft storage assembly comprising:

a plurality of supports, wherein each support includes a clamping bracket;

a shelf slidably attached to said plurality of supports by said clamping bracket attached to each said plurality of supports forming a watercraft storage area; and a support platform positioned within said watercraft storage area, wherein said support platform is adapted for supporting a watercraft partially or totally out of the water;

wherein said each said clamping bracket includes a first plate and a second plate that operate to press against said support forming a frictional fit with said support.

2. The watercraft storage structure of claim 1 wherein each said clamping bracket includes a u-shaped bracket and said shelf includes a plurality of support members, and wherein each said support member is supported within one said u-shaped bracket.

3. The watercraft storage structure of claim 1 wherein each said clamping bracket includes one or more clamping bolts which operate to in increase the frictional fit of said first plate and said second plate against said support when said one or more clamping bolts are tightened.

4. The watercraft storage structure of claim 1 further comprising a roof positioned over said shelf.

5. The watercraft storage structure of claim 1 wherein said plurality of supports are connected to a dock.

6. A watercraft storage structure for storing a watercraft partially or totally out of the water, the watercraft storage assembly comprising:

a plurality of supports, wherein one or more of said plurality of supports is connected to a dock and wherein each support includes a clamping bracket;

a shelf having a plurality of support members wherein said shelf is slidably attached to said plurality of supports by said clamping bracket attached to each said plurality of supports forming a watercraft storage area;

a roof positioned over said shelf and attached to said plurality of supports;

a support platform positioned within said watercraft storage area, wherein said support platform is adapted for supporting a watercraft partially or totally out of the water;

wherein said each said clamping bracket includes a u-shaped bracket for receive a portion of a support member a first plate and a second plate that operate to press against said support forming a frictional fit with said support; and wherein each said clamping bracket includes one or more clamping bolts which operate to in increase the frictional fit of said first plate and said second plate against said support when said one or more clamping bolts are tightened.

7. A watercraft storage structure for use with watercraft, said storage structure comprising:

a plurality of supports forming a watercraft storage area;

clamping brackets affixed to said supports at connection points;

a support platform positioned within said watercraft storage area for supporting a watercraft partially or totally out of water;

a shelf, wherein said shelf includes support members connected to said clamping brackets at said connection points, wherein one or more of said support members are slidably connected to one or more of said plurality of supports such that said shelf is positioned over said support platform and can move to increase or decrease the distance between said shelf and said support platform;

wherein each said support member that is slidably connected to a support is attached by a clamping bracket having a first plate and a second plate and at least one clamping bolt that operates to cause said first plate and said second plate to press against said support.

8. The watercraft storage structure of claim 7 wherein each said clamping bracket includes a u-shaped bracket and said shelf includes a plurality of support members, and wherein each said support member is supported within one said u-shaped bracket.

9. The watercraft storage structure of claim 7 wherein each said clamping bracket includes one or more clamping bolts which operate to in increase the frictional fit of said first plate and said second plate against said support when said one or more clamping bolts are tightened.

10. The watercraft storage structure of claim 7 further comprising a roof positioned over said shelf.

* * * * *